US007997916B2

(12) United States Patent
Yoshioka et al.

(10) Patent No.: US 7,997,916 B2
(45) Date of Patent: Aug. 16, 2011

(54) RESILIENT PLUG, FLUID PROOF CONSTRUCTION AND CONNECTOR

(75) Inventors: Chikahiro Yoshioka, Yokkaichi (JP); Yasuaki Nakayama, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/752,360

(22) Filed: Apr. 1, 2010

(65) Prior Publication Data

US 2010/0255703 A1 Oct. 7, 2010

(30) Foreign Application Priority Data

Apr. 3, 2009 (JP) ..... 2009-090909
Apr. 24, 2009 (JP) ..... 2009-106648

(51) Int. Cl.
*H01R 13/52* (2006.01)

(52) U.S. Cl. ..... 439/273; 439/271

(58) Field of Classification Search ..... 439/273, 439/274, 272, 271, 587
See application file for complete search history.

(56) References Cited

U.S. PATENT DOCUMENTS

| | | | | |
|---|---|---|---|---|
| 4,895,533 | A | 1/1990 | Yagi et al. | |
| 5,351,973 | A | 10/1994 | Taniuchi et al. | |
| 5,603,637 | A * | 2/1997 | Matsuoka et al. | 439/587 |
| 5,607,318 | A * | 3/1997 | Wakata et al. | 439/274 |
| 5,660,566 | A * | 8/1997 | Ohsumi | 439/587 |
| 5,667,406 | A * | 9/1997 | Tabata et al. | 439/587 |
| 5,720,487 | A * | 2/1998 | Kato | 277/637 |
| 6,764,329 | B2 | 7/2004 | Noguchi et al. | |
| 7,033,215 | B2 * | 4/2006 | Kobayashi | 439/587 |
| 7,147,500 | B2 * | 12/2006 | Tabata et al. | 439/274 |
| 7,371,114 | B2 * | 5/2008 | Tanaka | 439/587 |
| 2001/0049226 | A1 | 12/2001 | Murakami et al. | |
| 2005/0042906 | A1 | 2/2005 | Tabata et al. | |
| 2010/0075523 | A1 * | 3/2010 | Saitou | 439/273 |

FOREIGN PATENT DOCUMENTS

| | | |
|---|---|---|
| JP | 9199218 | 7/1997 |
| JP | 2002203636 | 7/2002 |
| JP | 2006-147421 | 6/2006 |

* cited by examiner

*Primary Examiner* — Hae Moon Hyeon
(74) *Attorney, Agent, or Firm* — Gerald E. Hespos; Michael J. Porco

(57) ABSTRACT

A rubber plug (40) is provided with a stable sealing property while reducing frictional resistance when the rubber plug (40) is inserted into a cavity. In a cross section including axis lines of the rubber plug (40), a cavity (11) and a wire (30), areas of outer lips (44A, 44B) not resiliently deformed radially outward of a virtual line (12L) corresponding to the inner circumferential surface of the cavity (11) are specified as outer virtual deforming portions (45A, 45B), areas of inner lips (46A, 46B and 46C) not resiliently deformed radially inward of a virtual line (31L) corresponding to the outer circumferential surface of the wire (30) are specified as inner virtual deforming portions (47A, 47B, and 47C) and at least parts of the inner virtual deforming portions (47A, 47B and 47C) correspond to only parts of the outer virtual deforming portions (45A, 45B).

12 Claims, 9 Drawing Sheets

RESILIENT PLUG, FLUID PROOF CONSTRUCTION AND CONNECTOR

BACKGROUND OF THE INVENTION

1. Field of the Invention

The invention relates to a resilient plug, particularly a rubber plug, to a fluidproof construction and to a connector.

2. Description of the Related Art

U.S. Pat. No. 6,764,329 discloses a rubber plug to be mounted on a wire connected with a terminal fitting and inserted into a cavity of a connector housing. Outer lips are formed on the outer circumferential surface of the rubber plug and closely contact the inner circumferential surface of the cavity while being resiliently deformed. Inner lips are formed on the inner circumferential surface of the rubber plug and closely contact the outer circumferential surface of the wire while being resiliently deformed.

The rubber plug is formed so that the inner and outer lips are displaced in a longitudinal direction to reduce frictional resistance when the rubber plug is inserted. Thus, no inner lips are present in areas of the inner circumferential surface aligned with the outer lips. The outer lips may displace to escape toward an inner circumferential side with a reaction force acting on the outer lips from the inner circumferential surface of the cavity. Therefore sealing between the outer lips and the inner circumferential surface of the cavity may become unstable.

Japanese Unexamined Patent Publication No. 2006-147421 discloses a conventional waterproof construction for a wire end. The wire has a conductor made of a twisted strands surrounded by an insulating coating. A cylindrical rubber plug is mounted on an end portion of the wire and held in close contact with the outer circumferential surface of the wire. The rubber plug is inserted together with the wire into a cavity formed in a housing, and the outer circumferential surface of the plug is held resiliently in close contact with the inner circumferential surface of the cavity.

The thickness of the insulating coating may be reduced if the wire is exposed to a high or low temperature environment. Thus, a difference between the minimum inner diameter of the rubber plug and the outer diameter of the wire increases and compressive stress acting on the inner circumferential surface of the wire decreases. As a result, a waterproof property between the wire and the rubber plug may be impaired.

On the other hand, a squeeze margin of the rubber plug against the wire could be set larger to ensure the waterproof property. Thus, insertion resistance upon inserting the wire into the rubber plug becomes excessive, thereby reducing assembling efficiency.

The invention was developed in view of the above situation and an object thereof is to obtain an appropriate sealing property.

SUMMARY OF THE INVENTION

The invention relates to a resilient plug, particularly a rubber plug, to be mounted on a wire connected to a rear end portion of a terminal fitting. The terminal fitting and the plug are inserted into a cavity of a connector housing. The plug has at least one outer lip to be held in close contact with the inner circumferential surface of the cavity while being resiliently deformed. The plug also has at least one inner lip to be held in close contact with the outer circumferential surface of the wire while being resiliently deformed. An outer virtual deforming portion is defined as an area of the outer lip that is not resiliently deformed and that is radially outward of a virtual line corresponding to the inner circumferential surface of the cavity in a cross section that includes axis lines of the resilient plug and the cavity. An inner virtual deforming portion is defined as an area of the inner lip that is not resiliently deformed radially inward of a virtual line corresponding to the outer circumferential surface of the wire in an undeformed state in the cross section including axis lines of the resilient plug and the wire. At least a part of the inner virtual deforming portion is arranged to correspond to only a part of the outer virtual deforming portion in a longitudinal direction. Accordingly, a stable sealing property is obtained while reducing frictional resistance when a resilient plug is inserted into a cavity.

A reaction force acting on the outer lip from the inner circumferential surface of the cavity is borne by the wire via the inner virtual deforming portion in the area of the outer virtual deforming portion of the outer lip corresponding to the inner virtual deforming portion. Thus, a sealing property by the outer lip is stabilized. Further, the area of the outer virtual deforming portion that does not corresponding to the inner virtual deforming portion is deformed to escape from the inner circumferential surface of the cavity. Therefore, frictional resistance between the inner and outer lips is reduced upon inserting the resilient plug into the cavity.

A plurality of outer virtual deforming portions may be arranged while being spaced apart in the longitudinal direction, and a front end portion and a rear end portion of one inner virtual deforming portion may correspond to two front and rear outer virtual deforming portions adjacent in the longitudinal direction. Thus, the number of the inner virtual deforming portions can be smaller and the shape of the inner circumferential surface of the resilient plug may be simplified as compared with the case where one inner virtual deforming portion corresponds to only one outer virtual deforming portion.

A plurality of inner virtual deforming portions may be spaced apart in the longitudinal direction and may correspond to a front end portion and a rear end portion of one outer virtual deforming portion. Thus, the outer virtual deforming portion may be supported at two positions, i.e. at its front and rear end portions by the inner virtual deforming portion. Accordingly, the posture of the inner virtual deforming portion may be stabilized and a high sealing property is exhibited.

Frictional resistance is generated between the outer lip and the inner circumferential surface of the cavity when the terminal fitting is inserted into the cavity and may cause a rear part of the resilient plug to deform excessively in the longitudinal direction. Accordingly, a crimpable tube may be provided continuous with the outer lip and may be fastened by a crimping portion of the terminal fitting from outside. At least one reinforcement may project in from the circumferential surface near a rear end of the crimpable tube to suppress excessive elongation of the resilient plug. The inner lip may double as the reinforcement. Thus, the shape of the inner circumferential surface of the resilient plug may be simplified as compared with the case where a special reinforcement is formed in addition to the inner lip.

The inner virtual deforming portion of the inner lip that may function as the reinforcement and may correspond to a rear end portion of the crimping portion in the longitudinal direction. Thus, the rear end portion of the crimpable tube portion reliably can be squeezed radially between the wire and the crimping portion. Therefore, there is no likelihood of elongating the rear end portion of the crimpable tube portion in the longitudinal direction.

A front end portion of the inner virtual deforming portion may correspond to the rear end portion of the crimping portion in the longitudinal direction, and a rear end portion of the inner virtual deforming portion may correspond to the front end portion of the outer virtual deforming portion in the longitudinal direction.

The inner virtual deforming portion has good functionality since it may function to suppress elongation of the rear end portion of the crimpable tube by possibly corresponding to both the crimping portion and the outer virtual deforming portion and also may function to bear a reaction force acting on the outer virtual deforming portion.

Outer circumferential shapes of the outer virtual deforming portion and/or of the inner virtual deforming portion may be arcuate or bent shapes with a substantially constant curvature.

A ratio of the overlapping area of a front of the outer virtual deforming portion with a rear of the inner virtual deforming portion to the entire length of the outer virtual deforming portion in the longitudinal direction preferably is less than about 40%. Similarly, a ratio of the overlapping area of the rear of the outer virtual deforming portion with the front of the inner virtual deforming portion to the entire length of the outer virtual deforming portion in the longitudinal direction preferably is less than about 40%.

The invention relates to a fluidproof construction for wire end. The construction includes a wire with a conductor surrounded by an insulating coating. The construction also includes the above-described resilient plug mounted on an end portion of the wire. The resilient plug mounted on the wire is to be inserted into a housing so that the outer circumferential surface of the plug is held resiliently in close contact with the inner circumferential surface of the housing and so that the inner circumferential surface of the plug is held resiliently in close contact with the outer circumferential surface of the wire. If it is assumed that D1 denotes the minimum inner diameter of the resilient plug and D2 denotes the outer diameter of the conductor, a relationship of D1>D2 is satisfied when the resilient plug and the wire are left alone and unbiased. However, a relationship of D1<D2 is satisfied when the wire is left alone and only the resilient plug is inserted in the housing. Accordingly, a fluid- or waterproof property is ensured without deteriorating an assembling operability.

The relationship of D1<D2 when only the rubber plug is inserted in the housing ensures that a squeeze margin of the rubber plug against the wire is ensured even if the insulating coating of the wire is deformed and thinned to an extreme level. As a result, a specified waterproof property is ensured.

Further, the relationship of D1>D2 before the resilient plug is inserted into the housing ensures that insertion resistance upon inserting the wire into the resilient plug does is not excessive and a good assembling operability is ensured.

At least one outer lip may be formed on the outer circumferential surface of the rubber plug for closely contacting the inner circumferential surface of the housing while being resiliently deformed. At least one inner lip may be formed on the inner circumferential surface of the resilient plug for closely contacting the outer circumferential surface of the wire while being resiliently deformed. The outer lip and the inner lip are arranged to partly overlap each other in a longitudinal direction of the wire. The squeeze margin of the resilient plug to be squeezed between the outer circumferential surface of the wire and the inner circumferential surface of the housing when the resilient plug is inserted into the housing increases by the overlapping parts. Thus, a higher waterproof property can be obtained.

A crimp area, to which the terminal fitting is to be crimped, may be provided in a front part of the outer circumferential surface of the resilient plug with respect to an inserting direction of the resilient plug into the housing.

A plurality of inner lips may be formed on the inner circumferential surface of the resilient plug for closely contacting the outer circumferential surface of the wire while being resiliently deformed. The inner lip located behind the crimp area, but closest to the crimp area, may have the minimum inner diameter of the resilient plug.

The above-described relational expressions defined are satisfied by the inner lip located closest to the crimp area to improve a waterproof property.

The invention also relates to a connector with a housing formed with at least one cavity. The connector also includes at least one terminal fitting to be inserted into the cavity and at least one wire connected with a rear end portion of the terminal fitting. The invention further includes at least one of the above-described resilient plugs. The resilient plug is mounted on the wire and inserted into the cavity together with the terminal fitting. More particularly, the resilient plug has an outer lip to be held in close contact with the inner circumferential surface of the cavity while being resiliently deformed and an inner lip to be held in close contact with the outer circumferential surface of the wire while being resiliently deformed. An outer virtual deforming portion is defined as an area of the outer lip not resiliently deformed radially outward of a virtual line corresponding to the inner circumferential surface of the cavity in a cross section including axis lines of the rubber plug and the cavity. An inner virtual deforming portion is defined as an area of the inner lip not resiliently deformed radially inward of a virtual line corresponding to the outer circumferential surface of the wire in an undeformed state in the cross section including axis lines of the rubber plug and the wire. At least a part of the inner virtual deforming portion is arranged to correspond to only a part of the outer virtual deforming portion in a longitudinal direction.

A reaction force acting on the outer lip from the inner circumferential surface of the cavity is borne by the wire via the inner virtual deforming portion in the area of the outer virtual deforming portion of the outer lip corresponding to the inner virtual deforming portion. Thus, a sealing property by the outer lip is stabilized. Further, the area of the outer virtual deforming portion not corresponding to the inner virtual deforming portion is deformed to escape from the inner circumferential surface of the cavity. Thus, frictional resistance between the outer lip and the inner lip is reduced upon inserting the resilient plug into the cavity.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENT

Figure 1:
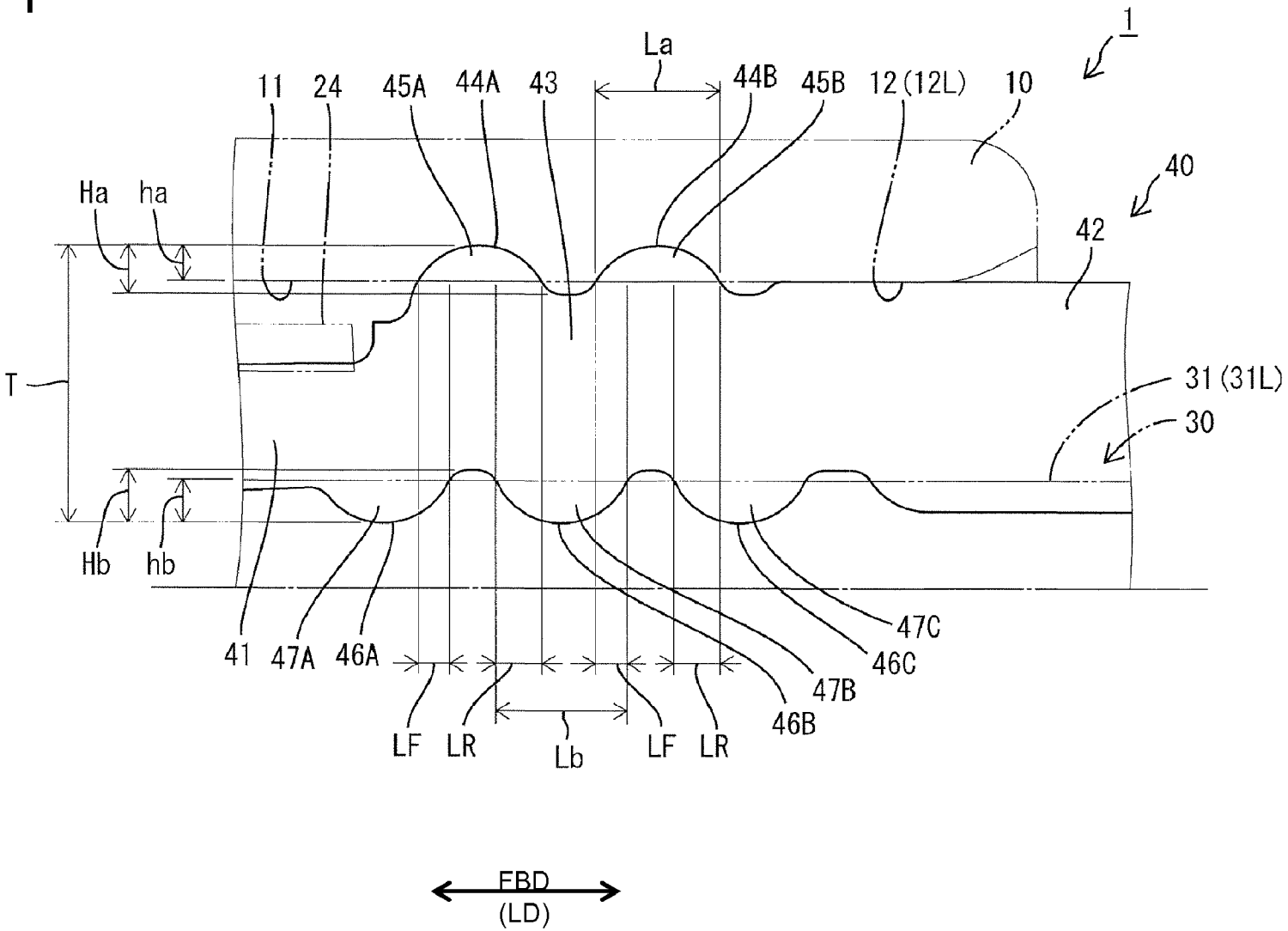
FIG. 1 is a diagram showing a connector according to one embodiment.
Figure 2:
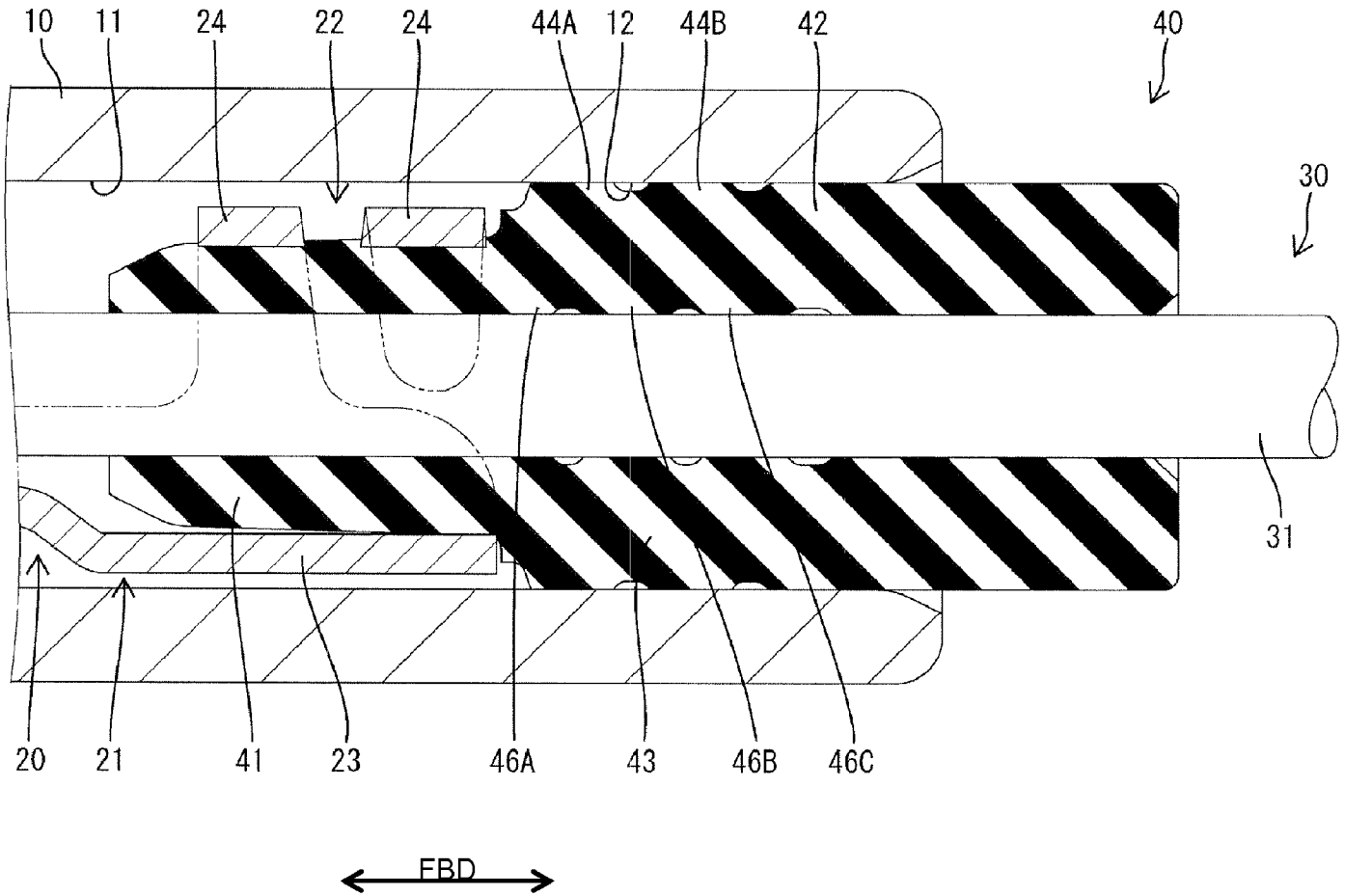
FIG. 2 is a section of the connector.
Figure 3:
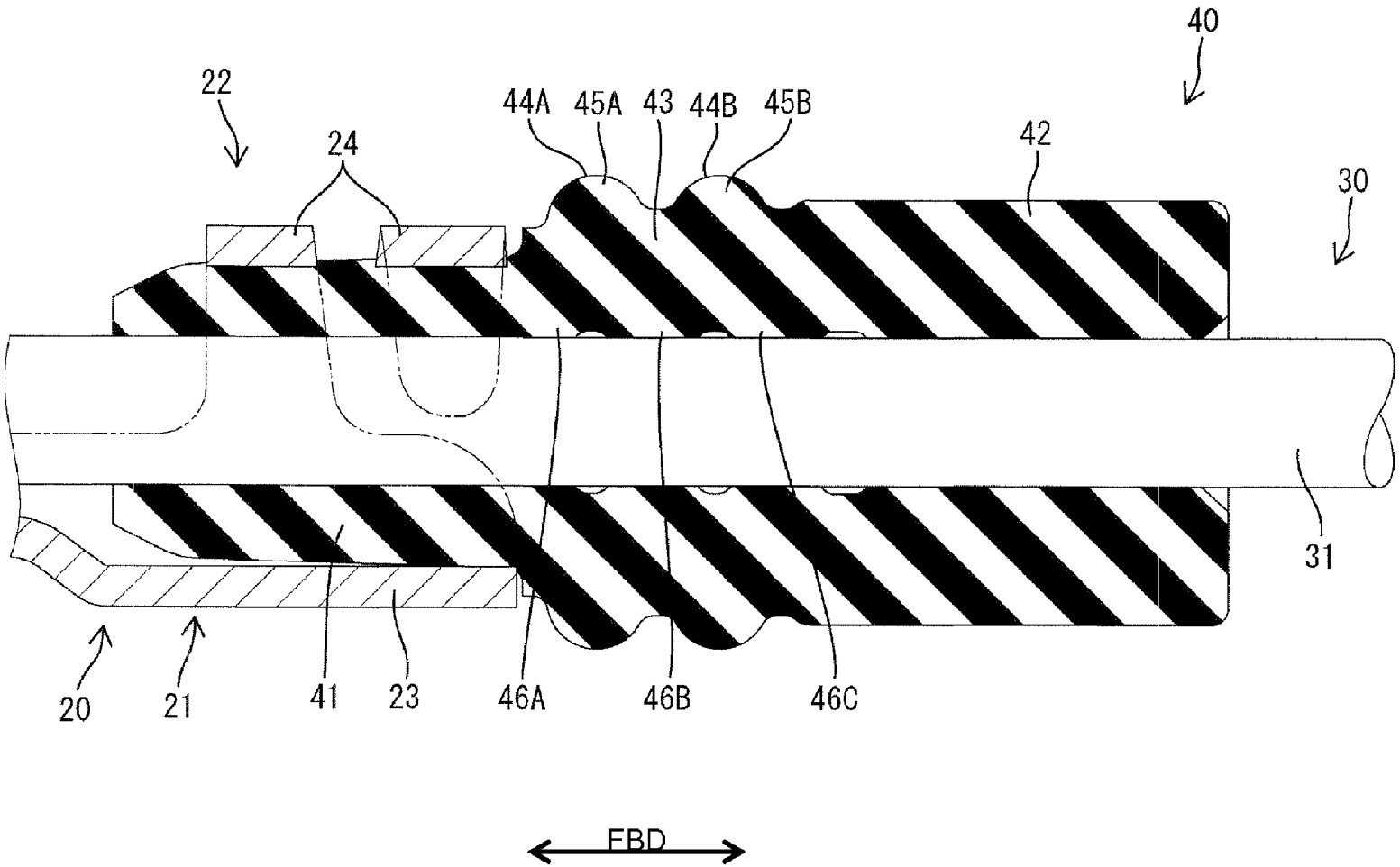
FIG. 3 is a section showing a state where a wire and the rubber plug are fastened to a terminal fitting.
Figure 4:
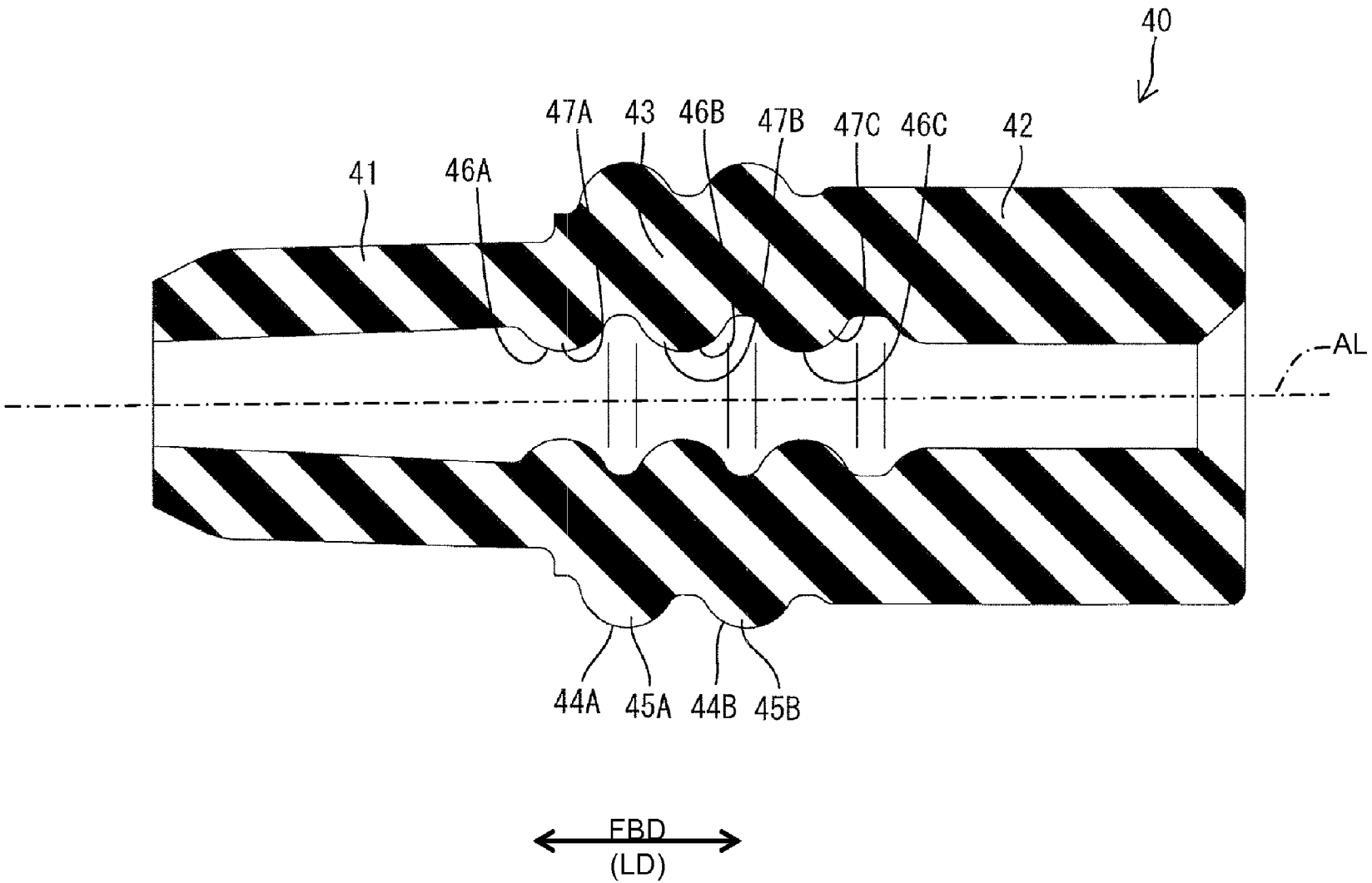
FIG. 4 is a section of the rubber plug.

A first embodiment of the invention is described with reference to FIGS. 1 to 4. A connector 1 of this embodiment is provided with a housing 10 made e.g. of synthetic resin, a conductive metallic terminal fitting 20, a wire 30 and a resilient plug 40, preferably a rubber plug 40. The connector housing 10 is formed with a cavity 11 which makes an opening in a rear opening surface of the connector housing 10, and a rear end portion of the inner circumferential surface of the cavity 11 serves as a sealing surface 12 having an axis line extending in forward and backward directions FBD and a circular cross section.

The terminal fitting 20 is narrow and long in forward and backward directions FBD and a crimping portion 21 to connect the wire 30 is formed at or near a rear end portion. Particularly, the crimping portion 21 is of a known form, wherein one or more, preferably a pair of crimping pieces 24 stand up or project from the lateral (preferably substantially opposite left and/or right) edge(s) of the base plate 23, a front end part of the crimping portion 21 serves as a wire barrel portion (not shown) and a rear end part of the crimping portion 21 serves as an insulation barrel portion 22.

The wire 30 is particularly such that a conductor (not shown) preferably having a substantially circular cross section is at least partly surrounded by an insulating coating 31 preferably substantially concentric with the conductor and preferably having a substantially cylindrical shape, and a front end portion thereof is to be connected with the wire connection portion (preferably the crimping portion 21). With the wire 30 and the terminal fitting 20 connected, the conductor particularly is electrically fixed to the wire barrel portion and the front end portion of the wire 30 in an area at least partly surrounded by the insulating coating 31 is fixed to the insulation barrel portion 22 preferably together with a crimpable tube portion 41 of the resilient (rubber) plug 40 to be described later. Such a terminal fitting 20 is to be at least partly inserted into the cavity 11 from an insertion side (preferably substantially from behind) with the wire 30 connected therewith.

The resilient plug 40 has a cylindrical shape whose axis line AL extends in forward and backward directions FBD (substantially parallel with the axis line of the sealing surface 12) and is mounted on or to the wire 30. A portion (preferably a front end area) of the resilient plug 40 serves as the crimpable tube portion 41 to be fixed to the insulation barrel portion 22 preferably by crimping. Another portion (preferably a rear end area) of the resilient plug 40 serves as a fitting portion 42 to be mounted at least partly inside and held in surface contact with the sealing surface 12 and/or to be at least partly mounted on and held in surface contact with the outer circumferential surface of the wire 30. A central or intermediate area of the resilient plug 40 between the crimpable tube portion 41 and the fitting portion 42 serves as a sealing portion 43.

The base plate 23 of the insulation barrel portion 22 and the one or more (pair of) crimping pieces 24 are crimped or bent or folded to wind at least partly around the outer circumferential surface of the crimpable tube portion 41. By this preferred crimping, the front end portion of the wire 30 and the rear end portions of the resilient plug 40 and the terminal fitting 20 are united, whereby the resilient plug 40 and the wire 30 are held in a substantially coaxial positional relationship with axis lines aligned substantially in coincidence. One of the pair of crimping pieces 24 is held in close contact with a rear end portion of the crimpable tube portion 41. In a state where the resilient plug 40 is not resiliently deformed, the inner circumferential surface of the crimpable tube portion 41 is so tapered or shaped divergently as to have a gradually smaller diameter toward the front and/or the inner diameter of the crimpable tube portion 41 is smaller than the outer diameter of the wire 30 over the entire length.

In the state where the resilient plug 40 is not resiliently deformed, the outer diameter of the fitting portion 42 preferably is equal to or slightly larger than the inner diameter of the sealing surface 12 of the cavity 11 and/or the inner diameter of the fitting portion 42 preferably is smaller than the outer diameter of the wire 30. Accordingly, with the resilient plug 40 mounted on the wire 30 and at least partly inserted in the cavity 11, no clearance is formed between the outer circumferential surface of the fitting portion 42 and the sealing surface 12 of the cavity 11 and/or no clearance is (preferably also) formed between the inner circumferential surface of the fitting portion 42 and the outer circumferential surface of the wire 30.

A first outer lip 44A and a second outer lip 44B located behind the first outer lip 44A are formed on the outer circumferential surface of the sealing portion 43, wherein the both outer lips 44A, 44B are so arranged as to be adjacent while being spaced apart in the longitudinal direction LD (forward and backward directions FBD). Here, a range of the outer lips 44A, 44B in a height direction is defined. Dimensions in a radial direction from a valley (minimum outer diameter portion of the sealing portion 43) between the both outer lips 44A and 44B to the tops (maximum outer diameter portions of the sealing portion 43) of the respective outer lips are specified as heights Ha of the outer lips 44A, 44B (see FIG. 1).

In a free state where the resilient plug 40 is not resiliently deformed, the maximum outer diameters of the both outer lips 44A, 44B preferably are equal to each other and/or larger than the inner diameter of the sealing surface 12 of the cavity 11 described above. In a cross section including the axis lines AL of the resilient plug 40 and the sealing surface 12, areas of the respective outer lips 44A, 44B not resiliently deformed radially outward of a virtual line 12L corresponding to the inner circumferential surface (sealing surface 12) of the cavity 11 are respectively specified as a first outer virtual deforming portion 45A and a second outer virtual deforming portion 45B (see FIG. 1).

In the cross section including the axis line of the resilient plug 40, the first and second outer virtual deforming portions 45A, 45B preferably have the substantially same shape, height Ha and/or dimension La in the longitudinal direction LD (forward and backward directions FBD). In this cross section, the outer circumferential shapes of the outer virtual deforming portions 45A, 45B preferably are arcuate or bent shapes preferably with a substantially constant curvature. In this embodiment, a ratio of the height ha of the outer virtual deforming portions 45A, 45B to the height Ha of the outer lips 44A, 44B in the radial direction particularly is about 75%, but this ratio can be arbitrarily set. Further, a ratio of an interval in the longitudinal direction LD between both front and rear outer virtual deforming portions 45A, 45B to a length La of one outer virtual deforming portion 45A, 45B in the longitudinal direction LD particularly is about 10:7, but this ratio can be arbitrarily set. Furthermore, a ratio of the height ha of the outer virtual deforming portions 45A, 45B to the length La thereof in the longitudinal direction LD particularly is about 2:7, but this ratio can be arbitrarily set.

A first inner lip 46A, a second inner lip 46B located behind the first inner lip 46A and a third inner lip 46C located behind the second inner lip 46B are formed on the inner circumferential surface of the sealing portion 43, wherein these inner lips 46A, 46B and 46C are so arranged at specified (predetermined or predeterminable) intervals as to be adjacent while being spaced apart in the longitudinal direction LD (forward and backward directions FBD). The interval of the outer lips 44A, 44B in the longitudinal direction LD and the intervals of the inner lips 46A, 46B and 46C in the longitudinal direction LD preferably are substantially equal. Here, a range of the inner lips 46A, 46B and 46C in a height direction is defined. Dimension in the radial direction from valleys (maximum inner diameter portions of the sealing portion 43) between the adjacent inner lips 46A, 46B and 46C to the tops (minimum inner diameter portions of the sealing portion 43) of the respective inner lips 46A, 46B and 46C are specified as heights Hb of the inner lips 46A, 46B and 46C.

In the free state where the resilient plug 40 is not resiliently deformed, the minimum inner diameters of all the inner lips 46A, 46B and 46C preferably are smaller than the outer diameter of the wire 30 in an undeformed state. In the cross section including the axis lines of the resilient plug 40 and the wire 30, areas of the first to third inner lips 46A, 46B and 46C not resiliently deformed radially inward of a virtual line 31L corresponding to the outer circumferential surface of the wire 30 (insulating coating 31) in an undeformed state are respectively specified as first to third inner virtual deforming portions 47A, 47B and 47C (see FIG. 1).

In the cross section including the axis line AL of the resilient plug 40, the second and third inner virtual deforming portions 47B, 47C preferably have the same shape, height hb and/or dimension Lb in the longitudinal direction. Further, in this cross section, the inner circumferential shapes of the second and third inner virtual deforming portions 47A, 47B are arcuate or bent shapes preferably with a substantially constant curvature. Since a front end portion of the inner virtual deforming portion 47A preferably is to be connected with the crimpable tube portion 41, the inner circumferential shape and the dimension in the longitudinal direction LD of the first inner virtual deforming portion 47A are different from those of the second and third inner virtual deforming portions 47B, 47C. The inner circumferential shape of most of the first inner virtual deforming portion 47A excluding the front end portion is an arcuate or bent shape preferably with a substantially constant curvature similar to the second and/or third inner virtual deforming portions 47B, 47C. The height hb of the first inner virtual deforming portion 47A preferably is substantially equal to those of the second and third inner virtual deforming portions 47B, 47C.

In this embodiment, ratios of the heights hb of the inner virtual deforming portions 47A, 47B and 47C to the heights Hb of the inner lips 46A, 46B and 46C in the radial direction particularly are about 78%, but these ratios can be arbitrarily set. Further, ratios of intervals of the adjacent inner virtual deforming portions 47A, 47B and 47C to a length Lb of one inner virtual deforming portion 47A, 47B or 47C in the longitudinal direction LD particularly are about 10:7, but these ratios can be arbitrarily set. Furthermore, ratios of the heights hb of the inner virtual deforming portions 47A, 47B and 47C to the lengths Lb thereof in the longitudinal direction LD particularly are about 1:3, but these ratios can be arbitrarily set.

In this embodiment, ratios of the heights ha of the outer virtual deforming portions 45A, 45B to a thickness T from the maximum outer diameter portions (tops of the outer lips) of the sealing portion 43 to the minimum inner diameter potions (tops of the inner lips 46A, 46B and 46C) in the radial direction particularly are about 13%, but these ratios can be arbitrarily set. Further, ratios of the heights hb of the inner virtual deforming portions 47A, 47B and 47C to the thickness T of the sealing portion 43 particularly are about 15%, but these ratios can be arbitrarily set. Ratios of the heights Ha of the outer virtual deforming portions 45A, 45B to the heights Hb of the inner virtual deforming portions 47A, 47B and 47C in the radial direction particularly are about 6:7, but these ratios can be arbitrarily set. Furthermore, ratios of the entire lengths La of the outer virtual deforming portions 45A, 45B to the entire lengths Lb of the inner virtual deforming portions 47B, 47C in the longitudinal direction LD particularly are about 10:11, but these ratios can be arbitrarily set.

In the state where the resilient plug 40 is not resiliently deformed, the outer lips 44A, 44B and the inner lips 46A, 46B and 46C preferably are so dimensioned and arranged as to partly overlap in the longitudinal direction LD (forward and backward directions FBD). Accordingly, both the outer virtual deforming portions 45A, 45B and the inner virtual deforming portions 47A, 47B and 47C preferably also partly overlap in the longitudinal direction LD (forward and backward directions FBD). Here, the partial overlap of the outer virtual deforming portions 45A, 45B and the inner virtual deforming portions 47A, 47B and 47C in the longitudinal direction LD means such an arrangement that parts of the inner virtual deforming portions 45A, 45B and parts of the inner virtual deforming portions 47A, 47B and 47C are substantially aligned in the radial direction.

Specifically, a rear end portion of the first inner virtual deforming portion 47A and a front end portion of the first outer virtual deforming portion 45A at least partly overlap, a rear end portion of the first outer virtual deforming portion 45A and a front end portion of the second inner virtual deforming portion 47B at least partly overlap, a rear end portion of the second inner virtual deforming portion 47B and a front end portion of the second outer virtual deforming portion 45B at least partly overlap and/or a rear end portion of the second outer virtual deforming portion 45B and a front end portion of the third inner virtual deforming portion 47C at least partly overlap.

According to how the outer virtual deforming portions 45A, 45B and the inner virtual deforming portions 47A, 47B and 47C overlap, the following technological thoughts can be extracted: (a) two inner virtual deforming portions 47A, 47B or 47B, 47C are so arranged while being spaced apart in the longitudinal direction LD (forward and backward directions FBD) as to correspond to the both front and rear end portions of one outer virtual deforming portion 45A, 45B, (b) the front and rear end portions of the second inner virtual deforming portion 47B substantially correspond to two outer virtual deforming portions 45A, 45B adjacent in the longitudinal direction, (c) any one of the inner virtual deforming portions 47A, 47B and 47C (inevitably) substantially corresponds to the both outer virtual deforming portions 45A, 45B and/or (d) all the three inner virtual deforming portions 47A, 47B and 47C (inevitably) substantially correspond to any one of the outer virtual deforming portions 45A, 45B.

In this embodiment, a ratio of overlapping areas LF of the front end portions of the outer virtual deforming portions 45A, 45B with the rear end portions of the first and second inner virtual deforming portions 47A, 47B to the entire length La of the outer virtual deforming portions 45A, 45B in the longitudinal direction LD particularly is less than about 40%, e.g. is about 25%, but this ratio can be arbitrarily set. Further, a ratio of overlapping areas LR of the rear end portions of the outer virtual deforming portions 45A, 45B with the front end portions of the first and second inner virtual deforming portions 47B, 47C to the entire length La of the outer virtual deforming portions 45A, 45B in the longitudinal direction LD particularly is less than about 40%, e.g. about 30%, but this ratio can be arbitrarily set.

The first inner lip 46A located foremost out of the three inner lips 46A, 46B and 46C preferably functions as a reinforcing portion for increasing the resilient rigidity of the rear end portion of the crimpable tube portion 41. This first inner lip 46A is in the form of a local projection from the inner circumferential surface of the resilient plug 40, and a formation range thereof in the longitudinal direction LD preferably extends from a position slightly before the rear end of an area of the crimpable tube portion 41 where the crimping pieces 24 are fastened from outside (i.e. rear end of the crimpable tube portion 41) to a position behind the rear end of the crimpable tube portion 41. In other words, a part of the front end side of the first inner virtual deforming portion 47A preferably is so arranged as to overlap with the rear end portion of the crimping piece 24 in the longitudinal direction LD (forward and backward directions FBD).

Next, functions of this embodiment are described. When the resilient plug 40 (preferably the rubber plug 40) is mounted on the wire 30 and fixed to the crimping portion 21, the inner virtual deforming portions 47A, 47B and 47C are held substantially in close contact with the outer circumferential surface of the wire 30 while being resiliently deformed, thereby fluid- or liquid-tightly sealing the clearance between the outer circumferential surface of the wire 30 and the inner circumferential surface of the resilient plug 40. Subsequently, when the terminal fitting 20 and the resilient plug 40 are at least partly inserted into the cavity 11, the outer virtual deforming portions 45A, 45B come to be held in close contact with the sealing surface 12 while being resiliently deformed, thereby fluid- or liquid-tightly sealing the clearance between the outer circumferential surface of the resilient plug 40 and the sealing surface 12 (inner circumferential surface of the cavity 11).

With the resilient plug 40 resiliently deformed in this way, the outer virtual deforming portions 45A, 45B and the inner virtual deforming portions 47A, 47B and 47C are kept partly overlapped. However, since the outer virtual deforming portions 45A, 45B and the inner virtual deforming portions 47A, 47B and 47C are radially squeezed and/or elongated in the longitudinal direction LD as compared with the state where the resilient plug 40 is not resiliently deformed, the overlapping dimensions LF, LR of the outer virtual deforming portions 45A, 45B and the inner virtual deforming portions 47A, 47B and 47C in the longitudinal direction LD are also increased as compared with the state where the resilient plug 40 is not resiliently deformed.

In areas of the outer virtual deforming portions 45A, 45B corresponding to the inner virtual deforming portions 47A, 47B and 47C, a reaction force acting from the sealing surface 12 (inner circumferential surface of the cavity 11) on the outer lips is substantially borne by the wire 30 via the inner virtual deforming portions 47A, 47B and 47C, wherefore a sealing property by the outer lips 44A, 44B is stabilized. Further, since areas of the outer virtual deforming portions 45A, 45B not corresponding to the inner virtual deforming portions 47A, 47B and 47C preferably are so deformed as to radially inwardly escape from the sealing surface 12, frictional resistance between the outer lips and the inner circumferential surface of the cavity 11 upon inserting the resilient plug 40 into the cavity 11 is reduced.

Since the second inner virtual deforming portion 47B preferably corresponds to the two outer virtual deforming portions 45A, 45B, the number of the inner virtual deforming portions 47A, 47B and 47C can be reduced as compared with the case where any one of the inner virtual deforming portions corresponds to only one outer virtual deforming portion, wherefore the shape of the inner circumferential surface of the resilient plug 40 is simplified.

Since the outer virtual deforming portions 45A, 45B preferably are supported at two positions, i.e. substantially at the front and rear end portions thereof by the inner virtual deforming portions 47A, 47B and 47C, the postures of the outer virtual deforming portions 45A, 45B are stabilized. Thus, even if a bending force acts on a part of the wire 30 drawn out from the connector housing 1, undesirable deformations of the outer lips 44A, 44B and the outer virtual deforming portions 45A, 45B are suppressed, wherefore a high sealing property is exhibited.

When the terminal fitting 20 is at least partly inserted into the cavity 11, a part of the resilient plug 40 between the rear end of the crimpable tube portion 41 and the first outer lip 44A (front end of the sealing portion 43) may be excessively elongated and deformed in the longitudinal direction LD due to the frictional resistance between the outer lips 44A, 44B and the inner circumferential surface (sealing surface 12) of the cavity 11. In this respect, in this embodiment, the rear end portion of the crimpable tube portion 41 preferably is thickened by causing the inner circumferential surface to locally project, thereby forming the first inner virtual deforming portion 47A, and this first inner virtual deforming portion 47A preferably functions as the reinforcing portion for increasing the resilient rigidity of the crimpable tube portion 41. Therefore, the excessive elongation of the resilient plug 40 can be suppressed.

Since this first inner virtual deforming portion 47A that functions as the reinforcing portion preferably corresponds to the rear end of the crimping piece 24 in the longitudinal direction, the rear end of the crimpable tube portion 40 is reliably radially squeezed between the wire 30 and the crimping piece 24. Therefore, there is no likelihood of elongating the rear end of the crimpable tube portion 41 in the longitudinal direction.

Since the first inner virtual deforming portion 47A preferably doubles as the reinforcing portion, the shape of the inner circumferential surface of the resilient plug 40 is simplified as compared with the case where a special reinforcing portion is provided in addition to the inner lips. Further, this first inner virtual deforming portion 47A has good functionality since preferably being provided with not only the function as the reinforcing portion for suppressing the elongation of the rear end portion of the crimpable tube portion 41, but also the function of bearing the reaction force acting on the first outer virtual deforming portion 45A by preferably at least partly overlapping with the front end portion of the first outer virtual deforming portion 45A.

Accordingly, to obtain a stable sealing property while reducing frictional resistance when a resilient plug (preferably a rubber plug) is at least partly inserted into a cavity, in a cross section including axis lines AL of a resilient plug 40, a cavity 11 and a wire 30, areas of outer lips 44A, 44B not resiliently deformed radially outward of a virtual line 12L corresponding to the inner circumferential surface of the cavity 11 are specified as outer virtual deforming portions 45A, 45B, areas of inner lips 46A, 46B and 46C not resiliently deformed radially inward of a virtual line 31L corresponding to the outer circumferential surface of the wire 30 are specified as inner virtual deforming portions 47A, 47B, and 47C and at least parts of the inner virtual deforming portions 47A, 47B and 47C correspond to only parts of the outer virtual deforming portions 45A, 45B.

Figure 5:
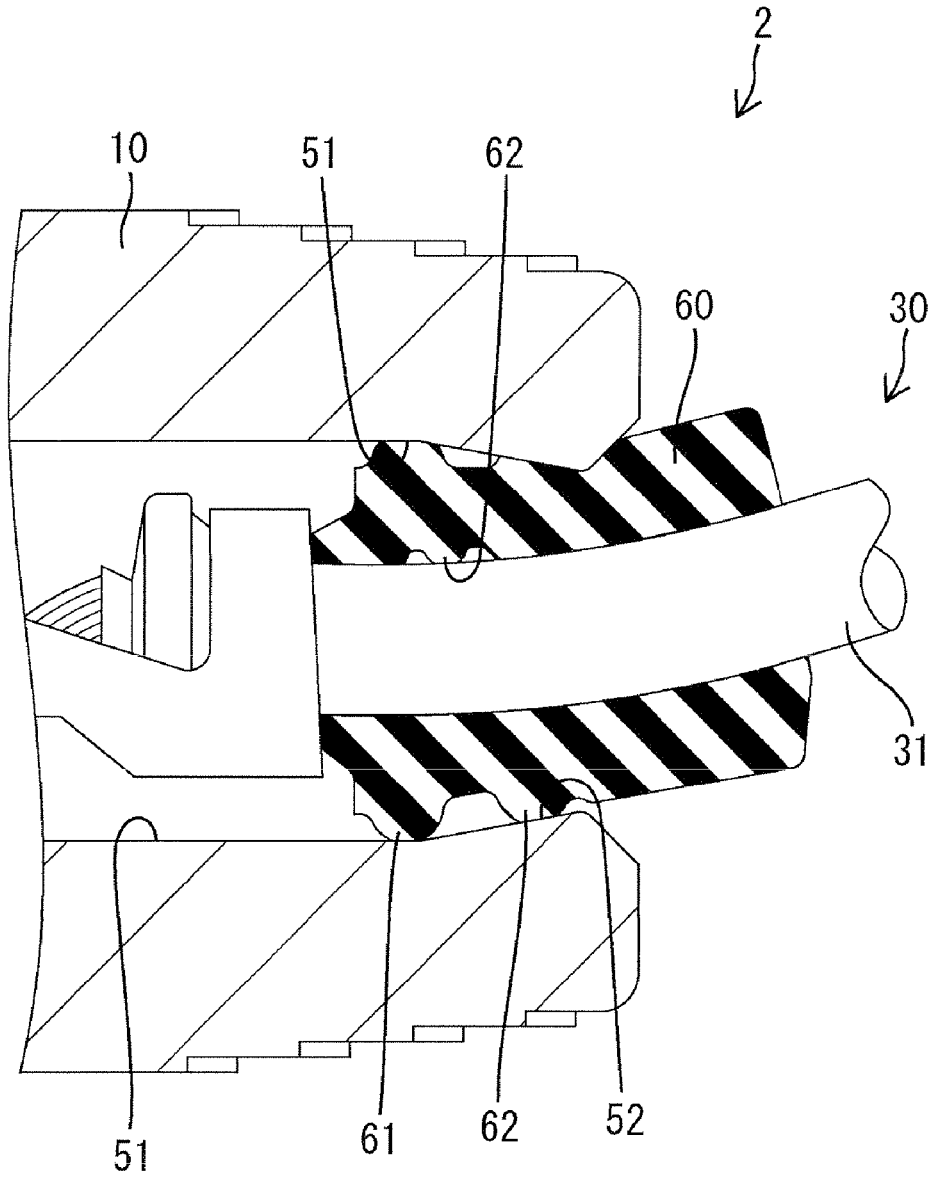
FIG. 5 is a section of a reference example.

Next, a reference example is described with reference to FIG. 5. A connector 2 of this reference example differs from the above embodiment in the shape of a sealing surface 51 of a cavity 50. Since essential parts of the other constructions are the same as in the above embodiment, the same constructions are identified by the same reference numerals and the structures, functions and effects thereof are not described.

Whereas the inner diameter of the sealing surface 12 is constant over the entire length (from the front end to the rear end) in the above embodiment, the inner diameter of a rear end part of the sealing surface 51 is gradually concentrically reduced toward the rear end, thereby forming a tapered surface 52. The inner diameter of the front end of the tapered surface 52 is equal to the inner diameter of the sealing surface 51. On the other hand, a resilient plug 60 (preferably a rubber plug 60) is formed with outer lips 61 on its outer circumferential surface and an inner lip 62 on its inner circumferential surface similar to the above embodiment. The tapered surface 52 strongly bites in the outer circumferential surface of the resilient plug 60.

According to such a mode, when a part of a wire 30 drawn out of the cavity 50 is pulled and a part of the wire 30 inserted through the resilient plug 60 is curved and deformed, the tapered surface 52 is held in close contact (biting in) the resilient plug 60 even if an area of the outer circumferential surface of the resilient plug 60 at an outer side of bending is displaced in a direction away from the tapered surface 52. Thus, a high sealing property is maintained.

The invention is not limited to the above described and illustrated embodiment(s). For example, the following embodiments are also included in the technical scope of the present invention.

Although only parts of the inner virtual deforming portions correspond to the outer virtual deforming portions in the above embodiment, the entire areas of the inner virtual deforming portions may correspond to the outer virtual deforming portions.

Although one inner virtual deforming portion corresponds to the two outer virtual deforming portion in the above embodiment, each inner virtual deforming portion may correspond to only one outer virtual deforming portion.

Although each outer virtual deforming portion corresponds to the inner virtual deforming portions at the two positions, i.e. at its front and rear end portions in the above embodiment, the two inner virtual deforming portions may correspond to the outer virtual deforming portion at its front end portion and central portion or at its rear end portion and central portion.

Although two inner virtual deforming portions correspond to one outer virtual deforming portion in the above embodiment, the number of the inner virtual deforming portion(s) corresponding to one outer virtual deforming portion may be only one, three or more. If only one inner virtual deforming portion corresponds to one outer virtual deforming portion, it may correspond to only any one of the front end portion, the rear end portion and the central portion of the outer virtual deforming portion. Further, three inner virtual deforming portions may correspond to the outer virtual deforming portion at three positions, i.e. at its front end portion, rear end portion and central portion.

Although the inner virtual deforming portions inevitably correspond to all of a plurality of outer virtual deforming portions in the above embodiment, there may be an outer virtual deforming portion not corresponding to the inner virtual deforming portions.

Although all of a plurality of inner virtual deforming portions inevitably correspond to the outer virtual deforming portions in the above embodiment, there may be an inner virtual deforming portion not corresponding to the outer virtual deforming portions.

Although the reinforcing portion is formed on the inner circumferential surface of the resilient (rubber) plug in the above embodiment, it may be formed on the outer circumferential surface of the resilient (rubber) plug.

Although the inner lip doubles as the reinforcing portion in the above embodiment, the reinforcing portion may be a special reinforcing portion which does not have a function as the inner lip.

Although the inner virtual deforming portion of the inner lip that functions as the reinforcing portion corresponds to the rear end portion of the crimping portion in the longitudinal direction in the above embodiment, this inner virtual deforming portion may not correspond to the rear end of the crimping portion in the longitudinal direction.

Although the inner virtual deforming portion of the inner lip that functions as the reinforcing portion corresponds to both the crimping portion and the outer virtual deforming portion in the above embodiment, this inner virtual deforming portion may correspond to the crimping portion, but not to the outer virtual deforming portion.

Although the heights of the two outer virtual deforming portions in the radial direction are equal in the above embodiment, they may differ.

Although the heights of the three inner virtual deforming portions in the radial direction are equal in the above embodiment, they may differ.

Although the invention has been described with reference to a rubber plug as a preferred resilient plug, it should be understood that the invention is applicable to a resilient plug made of any resilient material other than (natural or synthetic) rubber.

One further embodiment of the present invention is described with reference to FIGS. 6 to 9. In this embodiment is illustrated a waterproof construction for an end of a wire 110, in which a resilient plug (particularly a rubber plug) 120 is to be mounted on an end portion (front end portion) of the wire 110, a terminal fitting 140 is crimped or bent or folded and/or connected to the resilient plug 120 and to be at least partly inserted into a connector housing 160 together with the resilient plug 120 and the wire 110.

Figure 8:
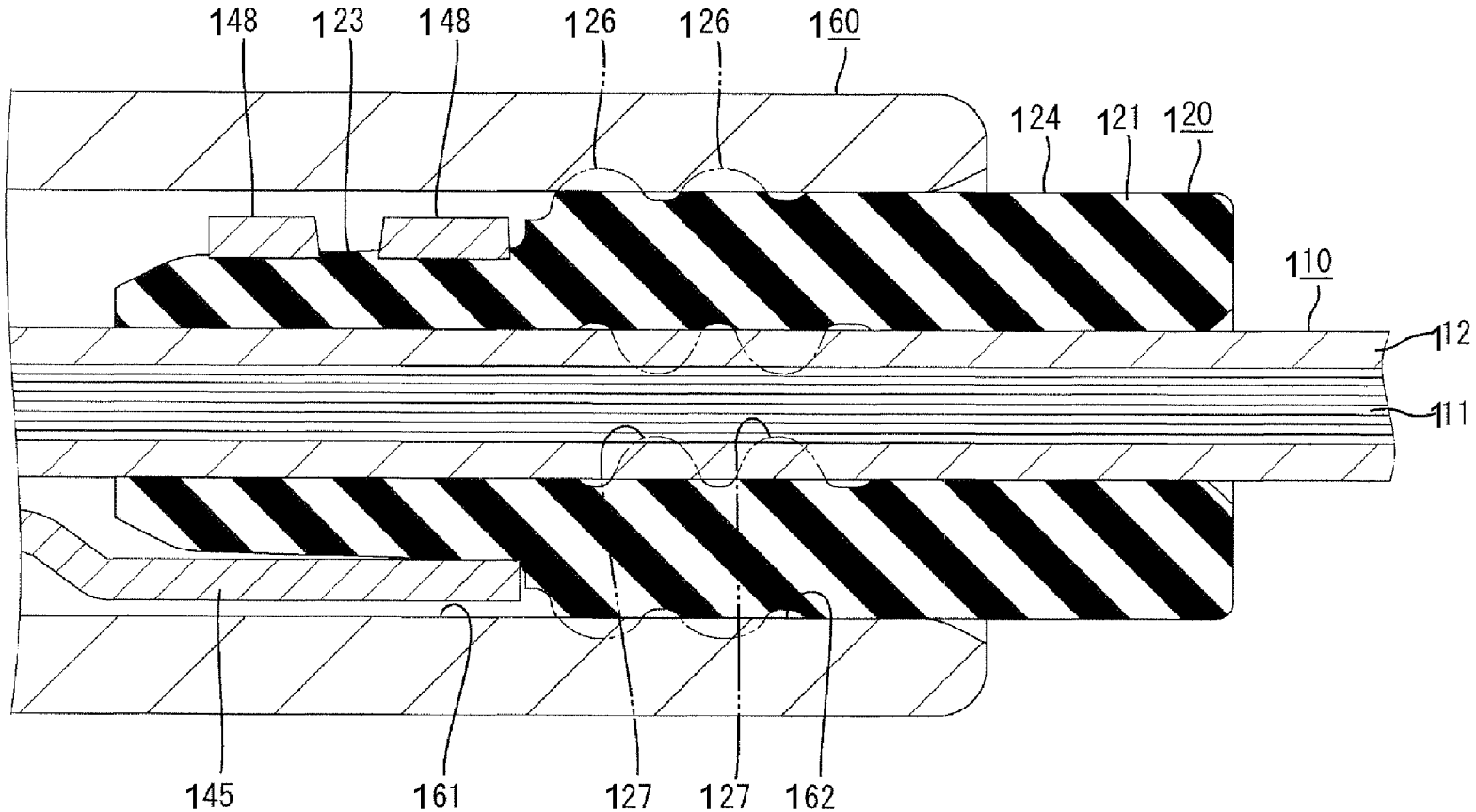
FIG. 8 is a section showing a state where the rubber plug is inserted in a rubber plug accommodating portion.

The connector housing 160 is made e.g. of synthetic resin and is internally formed with at least one cavity 161 extending substantially in forward and backward directions as shown in FIG. 8. A rear part of the cavity 161 serves as a resilient plug accommodating portion (particularly a rubber plug accommodating portion) 162 which particularly has a circular cross section and into which the resilient plug (particularly the rubber plug) 120 at least partly is to be closely accommodated.

The wire 110 is comprised of a conductor 111 (particularly made of a twisted wire obtained by twisting a plurality of metallic thin wires and/or having a substantially circular cross section), and an insulating coating 112 made e.g. of resin and at least partly surrounding the conductor 111. The insulating coating 112 is stripped off or at least partly removed at an end portion of the wire 110 to expose a front end portion of the conductor 111. The conductor 111 particularly is made of copper or copper alloy or, depending on cases, aluminum or aluminum alloy.

Figure 6:
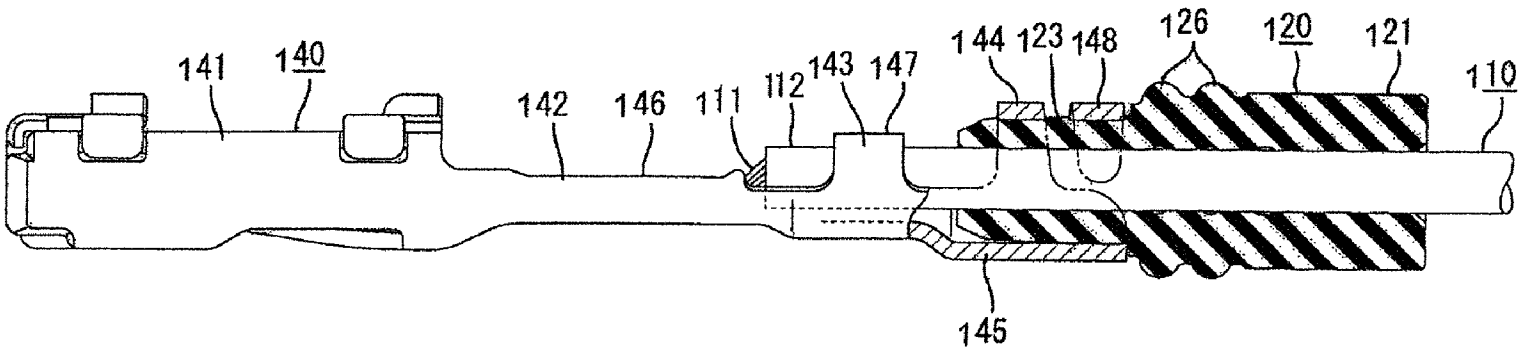
FIG. 6 is a side view partly in section showing a state where a rubber plug is mounted on an end portion of a wire and a terminal fitting is connected with a crimp area of the rubber plug.

The terminal fitting 140 is formed by applying bending, folding and/or embedding and the like to a conductive (metal) plate material punched out or cut into a specified (predetermined or predeterminable) shape and includes a substantially tubular connecting portion 141 for at least partly receiving a tab of an unillustrated mating terminal to be connected therewith, a wire connection portion, particularly comprising a wire barrel 142 located behind the connecting portion 141, a first insulation barrel 143 located behind the wire barrel 142 and/or a second insulation barrel 144 located behind the first insulation barrel 143, as shown in FIG. 6.

The wire barrel 142, the first insulation barrel 143 and/or the second insulation barrel 144 respectively include one or more, preferably pairs of crimping pieces 146, 147 and 148 extending from (particularly the substantially opposite lateral edges of) a bottom plate 145. The (both) crimping piece(s) 146 of the wire barrel 142 are crimped or wound or bent or folded at least partly around the outer circumferential surface of the exposed conductor 111 while particularly having the projecting ends thereof butted against each other, thereby being electrically connected with the conductor 111. The both crimping pieces 147 of the first insulation barrel 143 are crimped or wound or bent or folded at least partly around the outer circumferential surface of the insulating coating 112 while having the projecting ends thereof particularly butted against each other, thereby being held on the end portion of the wire 110. Further, the both crimping pieces 148 of the second insulation barrel 144 are crimped or bent or wound or folded at least partly around the outer circumferential surface of the resilient plug 120 while being substantially displaced in forward and backward directions, thereby being held on the end portion of the wire 110 together with the resilient plug 120.

Figure 9:
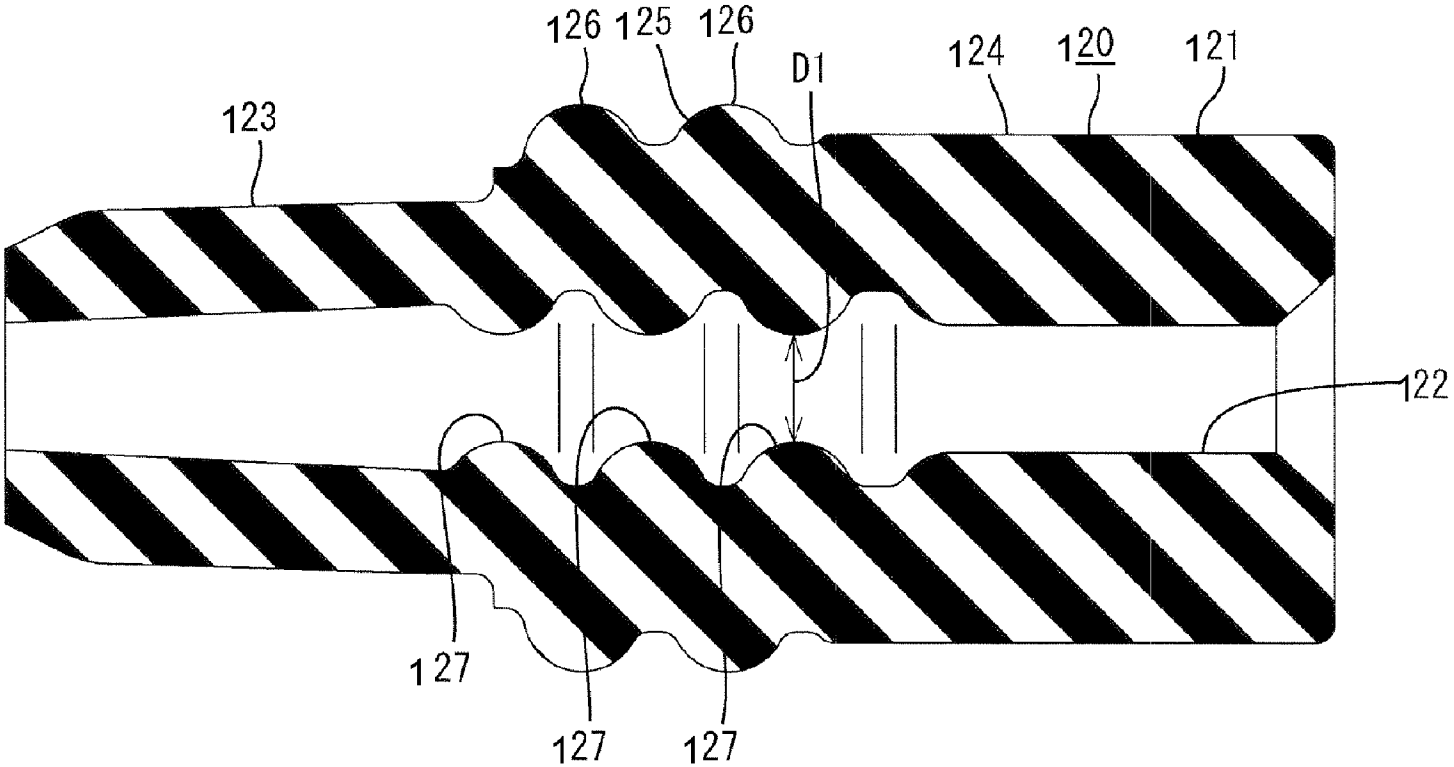
FIG. 9 is a section of the rubber plug.

The resilient plug 120 is made of a resilient material particularly of rubber such as silicon rubber and includes a cylindrical main body 121 substantially narrow and long in forward and backward directions as shown in FIG. 9. An insertion hole 122, into which the wire 110 is to be closely inserted, is formed to penetrate through the main body 121 substantially in forward and backward directions. A front part of the main body 121 serves as a crimp area 123 thinner than the other part. The outer circumferential surface of the crimp area 123 particularly is an even flat surface, to which the (both) crimping piece(s) 148 of the second insulation barrel 144 are crimped and connected. A rear part of the main body 121 serves as a thick trunk portion 124 whose inner and outer surfaces are even flat surfaces. The outer diameter of this trunk portion 124 particularly is substantially equal to the inner diameter of the resilient plug accommodating portion 162.

An intermediate part of the main body 121 serves as a seal area 125, and one or more, preferably a plurality of, specifically two outer rips 126 are formed on the outer circumferential surface of the seal area 125. The respective outer lips 126 are projections extending particularly over the substantially entire outer circumference of the main body 121. The projecting ends of the respective outer lips 126 are located outermost in the resilient plug 120 and/or are arranged substantially side by side substantially at the same height. Here, the outer circumferential surface of the seal area 125 preferably has a diameter gradually reduced from the outer circumferential surface of the trunk portion 124 to that of the crimp area 123, whereby the base end of the front outer lip 126 is located closer to an axial center than that of the rear outer lip 126.

One or more, preferably a plurality of, specifically three inner lips 127 are formed on the inner circumferential surface of the intermediate part of the main body 121, i.e. on the inner circumferential surface of the insertion hole 122 of the seal area 125. The respective inner lips 127 particularly are projections extending over the substantially entire inner circumference of the main body 121. The projecting ends of the respective inner lips 127 are located innermost in the resilient plug 120 and/or are arranged substantially side by side substantially at the same height.

Out of the respective inner lips 127, the one located foremost is substantially arranged to straddle or correspond between the seal area 125 and the crimp area 123. The respective outer lips 126 and the respective inner lips 127 are so arranged as to partly overlap in forward and backward directions (longitudinal direction of the wire 110). More specifically, a rear end portion of the inner lip 127 located foremost at least partly overlaps with a front end portion of the front outer lip 126, both front and rear end portions of the inner lip 127 located in the middle or at an intermediate position respectively at least partly overlap with a rear end portion of the front outer lip 126 and a front end portion of the rear outer lip 126, and/or a front end portion of the inner lip 127 located rearmost at least partly overlaps with a rear end portion of the rear outer lip 126. Overlapping parts are thicker than other parts.

In this embodiment, if it is assumed that D1 denotes the minimum inner diameter of the resilient plug 120, i.e. the inner diameters of the inner lips 127 (see FIG. 9), D2 denotes the outer diameter of the conductor 111 of the wire 110 (see FIG. 7) and D3 denotes the outer diameter of the insulating coating 112 of the wire 110, a relationship of D2>D1>D3 is satisfied in a natural state, i.e. in a state where the resilient plug 120 and the wire 110 are left alone. On the other hand, a relationship of D1>D2>D3 is satisfied when the wire 110 is left alone and the resilient plug 120 is singly inserted in the resilient plug accommodating portion 162 of the connector housing 160. The foremost one of the respective inner lips 127 is also included in the crimp area 123 and partly deviates from the seal area 125. Although all the inner lips 127 including the foremost one 127 are formed to satisfy the above relational expressions in this embodiment, the foremost inner lip 127 also included in the crimp area 123 may not satisfy the above relational expressions since these relational expressions relate to the evaluation of a sealing property.

Next, functions of this embodiment are described together with the significance of the above relational expressions.

The end of the wire 110 is inserted into the insertion hole 122 of the resilient plug 120 from behind. In the process of inserting the wire 110, frictional resistance does not increase as the wire 110 slides on the inner lips 127 and operability is good because the inner diameters D1 of the inner lips 127 are larger than the outer diameter D2 of the conductor 111 (D2<D1).

Figure 7:
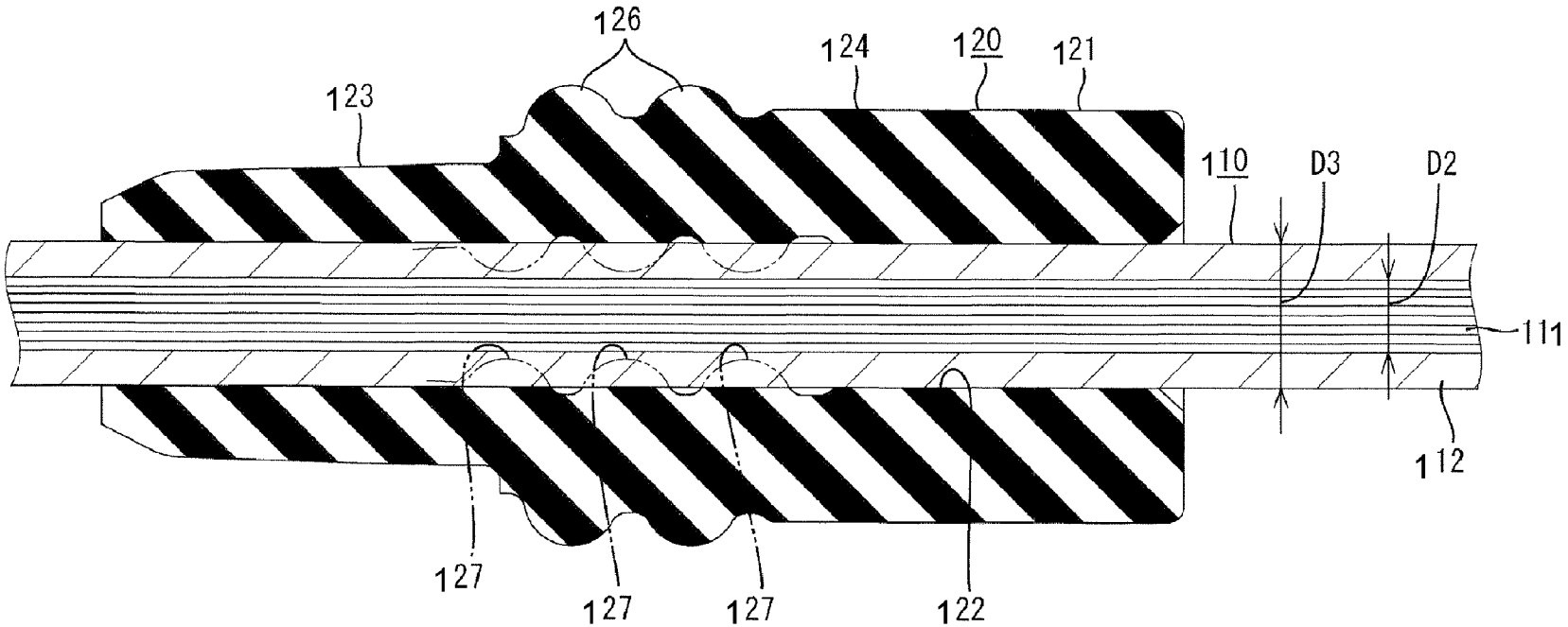
FIG. 7 is a section showing a state where the rubber plug is mounted on the end portion of the wire.

After the insertion of the wire 110 is completed, the inner circumferential surfaces of the trunk portion 124 and the crimp area 123 particularly are substantially entirely held in close contact with the outer circumferential surface of the wire 110 and/or the inner lips 127 particularly are held in close contact with the outer circumferential surface of the wire 110 while being resiliently deformed as shown in FIG. 7. At this time, squeeze margins of the inner lips 127 remain within the thickness range of the insulating coating 112 because the inner diameters D1 of the inner lips 127 are larger than the outer diameter D2 of the conductor 111 (D2>D1).

Subsequently, the end portions of the resilient plug 120 and the wire 110 are placed on the bottom plate 145 of the terminal fitting 140, the terminal fitting 140 and the like are set e.g. in an unillustrated automatic machine including an anvil and a crimper, the wire barrel 142 is crimped or bent or folded or deformed and connected to the conductor 111 of the wire 110 from outside, the first insulation barrel 143 is crimped or bent or folded or deformed and connected to the insulating coating 112 of the wire 111 from outside and the second insulation barrel 144 is crimped or bent or folded or deformed and connected to the crimp area 123 of the resilient plug 120 from outside.

In this state, the above terminal fitting 140 connected with the wire 110 and the resilient plug 120 is at least partly inserted into the cavity 161 of the connector housing 160 from an insertion side, particularly substantially from behind. When the terminal fitting 140 is properly inserted as shown in FIG. 8, a rear portion (particularly a substantially rear half) of the trunk portion 124 of the resilient plug 120 is arranged to project backward from the rear surface of the connector housing 160, and the outer lips 126 of the resilient plug 120 are substantially held in close contact with the inner circumferential surface of the resilient plug accommodating portion 162 while being resiliently deformed. Concurrently, the inner lips 127 are so displaced as to reduce their diameters and held in tight contact with the outer circumferential surface of the wire 110, whereby the squeeze margins of the inner lips 127 against the wire 110 increase more than before the insertion into the resilient plug accommodating portion 162. In other words, the squeeze margins of the inner lips 127 at this time go beyond the thickness range of the insulating coating 112 to reach the conductor 111 because the inner diameters D1 of the inner lips 127 are reduced more than before the insertion into the resilient plug accommodating portion 162 and become smaller than the outer diameter D2 of the conductor 111 (D1<D2).

Thereafter, the connector housing 160 is connected with an unillustrated mating connector housing, and the tab of the mating terminal mounted in the mating connector housing is at least partly inserted into the connecting portion 141 of the terminal fitting 140 as this connecting operation proceeds, whereby the both terminal fittings are electrically connected with each other.

If the wire 110 is placed in a high or low temperature environment, the insulating coating 112 is deformed to change e.g. reduce its thickness and, accordingly, the squeeze margins of the inner lips 127 may also decrease. Thus, the sealing property between the resilient plug 120 and the wire 110 may not be maintained.

However, since it is so designed that the inner diameters D1 of the inner lips 127 become smaller than the outer diameter D2 of the conductor 111 (D1<D2) in the inserted state of the resilient plug 120 in the resilient plug accommodating portion 162 according to this embodiment, the squeeze margins are inevitably ensured between the inner lips 127 and the conductor 111 even if the insulating coating 112 is thinned to an extreme level. As a result, a specified sealing property can be obtained.

In addition, since it is so designed that the inner diameters D1 of the inner lips 127 particularly are larger than the outer diameter D2 of the conductor 111 (D1>D2) before the insertion of the resilient plug 120 into the resilient plug accommodating portion 162, insertion resistance upon inserting the wire 110 into the insertion hole 122 of the resilient plug 120 does not become excessive and a good assembling operability is ensured.

Further, since the respective inner lips 127 and the respective outer lips 126 particularly partly overlap in forward and backward directions, the squeeze margin of the resilient plug 120 increases at the overlapping parts and a higher waterproof property can be obtained when the resilient plug 120 is inserted into the connector housing 160.

Further, since all the inner lips 127 including the one 127 closest to the crimp area 123 particularly satisfy the above relational expressions, a good sealing property is ensured at a position close to the connecting portion 141 of the terminal fitting 140. As a result, exposure of the connecting portion 141 to water or any other fluid is prevented and connection reliability between the two terminal fittings improves. Accordingly, to ensure a waterproof property without deteriorating an assembling operability, a resilient plug (particularly a rubber plug) 120 mounted on a wire 110 is at least partly inserted into a connector housing 160 to have the outer circumferential surface thereof resiliently held in close contact with the inner circumferential surface of the connector housing 160 and to have the inner circumferential surface thereof resiliently held in close contact with the outer circumferential surface of the wire 110. If it is assumed that D1 denotes the minimum inner diameter of the resilient plug 120 and D2 denotes the outer diameter of a conductor 111 of the wire 110, a relationship of D1>D2 particularly is satisfied when the resilient plug 120 and the wire 110 are respectively left alone, whereas a relationship of D1<D2 is satisfied when the wire 110 is left alone and only the resilient plug 120 is inserted in the connector housing 160.

The invention is not limited to the above described and illustrated embodiment(s). For example, the following embodiments are also included in the technical scope of the present invention.

Although the resilient plug individually corresponding to each wire is illustrated in the above embodiment, the resilient plug may be a one-piece resilient plug formed with a plurality of insertion holes for permitting the passage of wires according to the present invention.

Either ones or both of the inner lips and the outer lips may be omitted.

The numbers of the inner lips and the outer lips are arbitrary.

The respective outer lips may include one whose projecting end is located at a different height. Further, the respective inner lips may include one whose projecting end is located at a different height. In this case, out of the inner lips located behind the crimp area, the foremost one, i.e. the one located closest to the crimp area may satisfy the relational expressions of the present invention according to the invention or a preferred embodiment thereof by having the minimum inner diameter of the resilient plug. By doing so, it can be effectively prevented that the terminal fitting is exposed to water to impair the waterproof property.

The present invention is also applicable to a resilient plug including no crimp area, to which a terminal fitting is crimped and connected.

Although the invention has been described with reference to a rubber plug as a preferred resilient plug, it should be understood that the invention is applicable to a resilient plug made of any resilient material other than (natural or synthetic) rubber.

What is claimed is:

1. A resilient plug to be mounted on a wire connected with a portion of a terminal fitting and to be at least partly inserted into a cavity of a housing together with the terminal fitting, the cavity having an inner circumferential surface, the resilient plug comprising:

a plurality of outer lips to be held in close contact with the inner circumferential surface of the cavity while being resiliently deformed and a plurality of inner lips to be held in close contact with an outer circumferential surface of the wire while being resiliently deformed;

outer virtual deforming portions being defined by areas of each of the outer lips not resiliently deformed radially outward of a virtual line corresponding to the inner circumferential surface of the cavity in a cross section including axis lines of the resilient plug and the cavity;

inner virtual deforming portions being defined by areas of each of the inner lips not resiliently deformed radially inward of a virtual line corresponding to the outer circumferential surface of the wire in an undeformed state in the cross section including axis lines of the resilient plug and the wire; and at least a part of each of the inner virtual deforming portions being arranged to correspond to only a part of any one of the outer virtual deforming portion in a longitudinal direction and at least one of the inner virtual deforming portions being arranged to correspond to parts of two of the outer virtual deforming portions.

2. The resilient plug of claim 1, wherein:

a crimpable tube is provided before and continuous with one of the outer lips at a position to be fastened by a crimping portion of the terminal fitting from outside; and at least one reinforcement projects from an inner circumferential surface of the resilient plug at a rear end portion of the crimpable tube.

3. The resilient plug of claim 2, wherein the inner lips include a front inner lip, the front inner lip defining the reinforcement and projecting from the inner circumferential surface of the rear end of the crimpable tube.

4. The resilient plug of claim 3, wherein the inner virtual deforming portion of the front inner lip aligns with a rear end portion of the crimping portion in the longitudinal direction.

5. The resilient plug of claim 3, wherein:

a front end portion of the inner virtual deforming portion of the front inner lip corresponds to the rear end portion of the crimping portion in the longitudinal direction, and a rear end portion of the inner virtual deforming portions of the front inner lip corresponds to a front end portion of one of the outer virtual deforming portions in the longitudinal direction.

6. The resilient plug of claim 1, wherein circumferential shapes of the outer virtual deforming portions and the inner virtual deforming portions are arcuate shapes with a substantially constant curvature.

7. The resilient plug of claim 1, wherein a ratio of overlapping area of each of the outer virtual deforming portions with a corresponding one of the inner virtual deforming portions to an entire length of the corresponding outer virtual deforming portion in the longitudinal direction is less than about 40%.

8. A fluidproof construction for wire end, comprising:

a wire with a conductor surrounded by an insulating coating; and a resilient plug mounted on an end portion of the wire and being insertable into a housing dimensioned so that an outer circumferential surface of the resilient plug is held resiliently in close contact with an inner circumferential surface of the housing and so that an inner circumferential surface of the resiliently plug is held in close contact with an outer circumferential surface of the wire; and the resilient plug having a minimum inside diameter of D1 and the conductor having an outer diameter of D2 selected so that a relationship of D1>D2 is satisfied when the resilient plug and the wire are unbiased, whereas a relationship of D1<D2 is satisfied when the wire is unbiased and only the resilient plug is inserted in the housing.

9. The fluidproof construction for wire end of claim 8, wherein:

at least one outer lip is formed on the outer circumferential surface of the resilient plug and is dimensioned for closely contacting the inner circumferential surface of the housing while being resiliently deformed;

at least one inner lip is formed on the inner circumferential surface of the resilient plug for closely contacting the outer circumferential surface of the wire while being resiliently deformed; and the outer lip and the inner lip being arranged to partly overlap each other in a longitudinal direction of the wire.

10. The fluidproof construction for wire end of claim 9, wherein a crimp area, to which a terminal fitting is to be crimped and connected, is provided in a front part of the outer circumferential surface of the resilient plug with respect to an inserting direction of the resilient plug into the housing.

11. The fluidproof construction for wire end of claim 10, wherein a plurality of the inner lips are formed on the inner circumferential surface of the resilient plug for closely contacting the outer circumferential surface of the wire while being resiliently deformed, the plurality of inner lips including a front inner lip located closest to and behind the crimp area and defining a minimum inner diameter of the resilient plug.

12. A connector, comprising:

a housing formed with a cavity having an inner circumferential surface;

a terminal fitting inserted into the cavity;

a wire connected with a portion of the terminal fitting; and a resilient plug mounted on the wire, including a portion of the wire connected to the terminal fitting, the resilient plug including:

a plurality of outer lips to be held in close contact with the inner circumferential surface of the cavity while being resiliently deformed and a plurality of inner lips to be held in close contact with an outer circumferential surface of the wire while being resiliently deformed;

outer virtual deforming portions being defined by areas of each of the outer lips not resiliently deformed radially outward of a virtual line corresponding to the inner circumferential surface of the cavity in a cross section including axis lines of the resilient plug and the cavity;

inner virtual deforming portions being defined by areas of each of the inner lips not resiliently deformed radially inward of a virtual line corresponding to the outer circumferential surface of the wire in an undeformed state in the cross section including axis lines of the resilient plug and the wire; and at least a part of each of the inner virtual deforming portions being arranged to correspond to only a part of any one of the outer virtual deforming portion in a longitudinal direction and at least one of the inner virtual deforming portions being arranged to correspond to parts of two of the outer virtual deforming portions.

* * * * *